US007134563B2

(12) United States Patent
Meissner et al.

(10) Patent No.: US 7,134,563 B2
(45) Date of Patent: Nov. 14, 2006

(54) CRANE WITH MANUAL INPUT DEVICES

(75) Inventors: Klaus Meissner, Zweibruecken (DE); Mathias Meyer, Pirmasens (DE)

(73) Assignee: Terex-Demag GmbH & Co., KG, Zweibruecken (DE)

( * ) Notice: Subject to any disclaimer, the term of this patent is extended or adjusted under 35 U.S.C. 154(b) by 13 days.

(21) Appl. No.: 10/502,990

(22) PCT Filed: Jan. 29, 2003

(86) PCT No.: PCT/DE03/00285

§ 371 (c)(1),
(2), (4) Date: Jul. 29, 2004

(87) PCT Pub. No.: WO03/066503

PCT Pub. Date: Aug. 14, 2003

(65) Prior Publication Data

US 2005/0098521 A1 May 12, 2005

(30) Foreign Application Priority Data

Feb. 4, 2002 (DE) ..... 102 04 498

(51) Int. Cl.
*B66C 13/06* (2006.01)

(52) U.S. Cl. ..... 212/275; 212/276; 212/284; 212/290

(58) Field of Classification Search ..... 212/272–275, 212/276, 284, 290
See application file for complete search history.

(56) References Cited

U.S. PATENT DOCUMENTS 5,089,972 A * 2/1992 Nachman et al. ..... 700/218
5,267,441 A * 12/1993 Devier et al. ..... 60/452
5,731,974 A * 3/1998 Pietzsch et al. ..... 700/83
5,950,428 A * 9/1999 Nam et al. ..... 60/421
6,193,086 B1 * 2/2001 Gunnlaugsson et al. .... 212/290
6,485,247 B1 * 11/2002 Groves et al. ..... 414/589
6,546,724 B1 * 4/2003 Nishimura et al. ..... 60/431
6,744,372 B1 * 6/2004 Shaw et al. ..... 340/685

FOREIGN PATENT DOCUMENTS

| | | |
|---|---|---|
| FR | 2692419 | 12/1993 |
| JP | 64-069498 | 3/1989 |
| JP | 09-242124 | 9/1997 |
| JP | 2000-086155 | 3/2000 |

OTHER PUBLICATIONS

International Search Report dated Jun. 10, 2003 issued for the corresponding International Application No. PCT/DE03/00285.

* cited by examiner

*Primary Examiner*—Thomas J. Brahan
(74) *Attorney, Agent, or Firm*—Cohen, Pontani, Lieberman & Pavane

(57) ABSTRACT

The invention relates to a crane that comprises an electronic control for actuating drives for at least one lifting gear and for crane movements, which can be operated by an operator via manual input devices. Said manual input devices can be adjusted as regards their sensitivity (definition). In order to adapt the system behavior of the crane to the needs of different operators and different lifting requirements in an optimum manner, the electronic control is provided with at least two adjustments, selectable by the operator, that set for the manual input devices respective different sensitivities defined for the crane operation.

14 Claims, 1 Drawing Sheet

CRANE WITH MANUAL INPUT DEVICES

CROSS REFERENCE TO RELATED APPLICATIONS

This is a U.S. national stage application under 35 U.S.C. §371 of international stage application No. PCT/DE03/00285, filed on Jan. 29, 2003. Priority is claimed under 35 U.S.C. §119(*a*) and 35 U.S.C. §365(*b*) from German Patent Application No. 102 04 498.8, Filed: Feb. 4, 2002, and from which priority was properly claimed in the aforementioned international stage application.

FIELD OF THE INVENTION

The invention concerns a crane with an electronic control system that can be operated by an operator via manual input devices for actuating drives for at least one hoisting unit and for crane movements, wherein the manual input devices can be adjusted in sensitivity or resolution or dampening.

BACKGROUND OF THE INVENTION

A crane normally has not only a drive for at least one hoisting unit for hoisting a load, but also one or more drives for carrying out crane movements. Examples of such crane movements are adjustment of the inclination of the boom of the crane and especially swiveling movements of the boom about a vertical axis of rotation. The given drives are actuated via manual input devices, which are usually designed in the form of control levers. The speed of the given drive linked with the control level can be adjusted as desired to variably large values by variable displacement of the control lever.

Modern cranes are normally provided with an electronic control system, which receive their control commands via the aforementioned manual input devices and convert them to corresponding signals for controlling the drives. In order to guarantee uniform factory-set system performance, it is customary to compensate tolerances of mechanical and electronic components, which would lead to different system performance in the individual cranes, by suitable adjustment of their action, so that practically the same performance can be guaranteed in each device of a crane type. This means that, as a result of the adjustment, when a manual input device is operated in a certain way, the given drive always responds in the same way, independently of which device of the given type is presently being used. This eliminates the need for the crane operator to go through a learning phase to adjust to the performance of a crane that is new to him when he changes between individual cranes.

The requirements on the operability of a crane can sometimes vary greatly, depending on the specific application. In the case of the lifting of relatively small loads at construction sites, one is often primarily interested in high operating speeds and less on carrying out exact positioning maneuvers. Just the opposite is true in the case of assembly work, which depends on exact positioning of the suspended load, which is often very heavy, and less on especially fast execution of the work. With previously known crane control systems, it has not been possible to take into account the varying skill levels of crane operators with respect to operating the manual input devices for controlling the crane drives for different applications with the most effective sensitivity.

BRIEF SUMMARY OF THE INVENTION

The objective of the present invention is to further develop a crane of the general type described above in such a way that, in accordance with the requirements of the given lifting task that is to be carried out with the crane, optimum operation by crane operators can be guaranteed, despite their different performance attributes. In other words, lifting tasks, whose performance with conventional control systems normally required a crane operator with especially high sensitivity, should also be capable of being satisfactorily performed by crane operators with less well developed performance qualities.

This objective is achieved with a crane of the general type described above by providing the electronic control system with at least two settings, which can be selected by the operator and which preset different manual input device sensitivities defined for the crane operation. The present invention thus utilizes the possibility of setting the sensitivity of manual input devices, i.e., setting their resolution or spread or dampening, in order very purposefully to bring about a performance of the system of the crane drives that is significantly different from normal performance. In this regard, however, in each case it is a question of reproducibly different system performance, which is always obtained whenever the electronic control was correspondingly selected by the crane operator.

It is especially advantageous to provide one of the selectable settings of the electronic control system for assembly operation (assembly setting). In this regard, compared to a normal setting of the electronic control system preset at the factory, the displacement of a manual input device into a certain control position results in each case in relatively much slower movement of the given drive. The so-called ramping times that elapse between the time a drive starts and the time it reaches its given desired speed can also be variably adjusted.

Furthermore, it is advantageous to provide at least one high-speed setting, in which the displacement of a manual input device into a certain control position results in significantly faster movement of the given drive and possibly also in a reduction of the ramping times compared to a normal setting of the electronic control system preset at the factory.

It is advisable for the crane operator himself to be able to set the settings that differ from the factory-preset normal setting. Therefore, it is advantageous to provide the electronic control system with suitable input devices that make this possible. The use of a touch screen connected to the electronic control system has been found to be especially advantageous in this regard, because this not only allows easily learnable programming, for example, by displayed symbols, but also provides a display of the values that are set.

It is advantageous for a factory-set normal setting to be safely stored in the electronic control system in such a way that a change can be made only by trained personnel. This ensures that, in the event of confused programming, in which the manual input devices are set in an objectively nonsensical way with respect to their sensitivity, it is easily possible to make an easy return to a suitable basic setting.

For assembly operation, it is advantageous to increase the spread of the manual input devices significantly relative to the normal setting, i.e., to reduce the sensitivity or to increase dampening, so that sensitive adjustment is ensured even by operating personnel who operate less sensitively. The spread or dampening of the manual input devices for assembly operation can be so pronounced that the maximum speed of the given drive associated with it can no longer be achieved in the normal case, but rather can be activated only by switching to another type of operation.

DETAILED DESCRIPTION OF THE PREFERRED EMBODIMENTS

Figure 1:
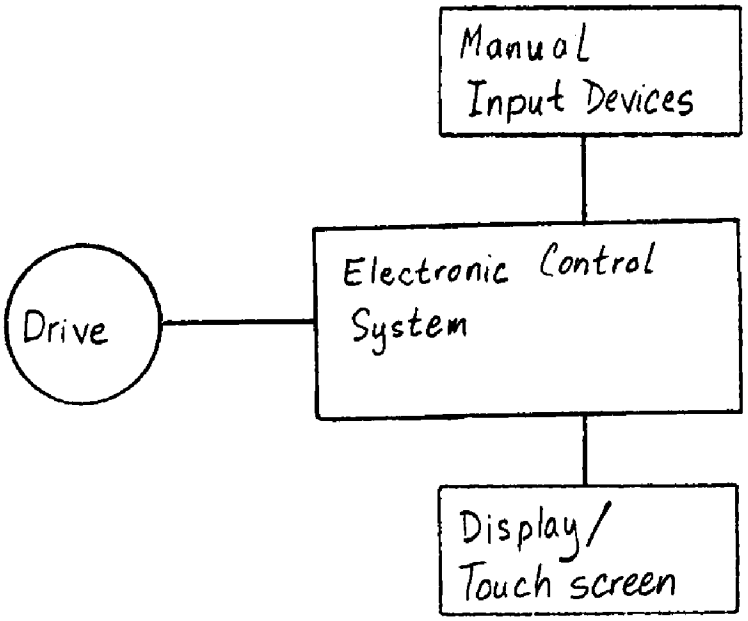
FIG. 1 is a block diagram of the components of the control system of a crane according to an embodiment of the present invention.

FIG. 1 shows that manual input devices control drives of a crane through an electronic control system. As described below, a display of the electronic control system displays current control settings to an operator of the crane. In a preferred embodiment of the invention, the sensitivity of the manual input devices is not adjusted linearly but rather is adjusted in the form of a characteristic curve, in which there is comparatively high resolution of the control movements in an initial fine-control range (large spread), and progressively changing behavior of the characteristic curve is provided in the remainder of the range until the maximum speed of the given drive is smoothly attained (smaller spread). This makes it possible, in a single adjustment of the electronic control system, to fulfill lifting tasks with strongly differing requirements, i.e., to satisfy both the requirements of relatively precise drive control and those of high-speed operation.

It is especially advantageous from the standpoint of the safety of crane operation if the electronic control system has a control program that excludes the storage of settings in which the values of speed and dynamics that can be achieved would be beyond the values that are permissible for the crane.

It is especially advantageous to store the settings individually carried out for the given operator in a specially secured form in the control system. This can be accomplished, for example, by a personal code. Of course, it is also possible to make the settings assigned to an operator accessible by an identifying chip card or the like. This also makes it possible to prevent the programming of one operator from being changed, intentionally or unintentionally, by another crane operator.

It is advisable to continuously display the given setting selected for the current operation to the operator, so that operating errors can be excluded in advance. Otherwise, dangerous situations could be produced by confusing the setting for assembly operation with the setting for high-speed operation.

The design of the electronic control system of a crane in accordance with the invention makes it possible to adapt the performance of the manual input devices of the crane to the individual needs of the given crane operator and the given lifting task in an especially favorable way. In order to be able to move, for example, a valuable load with a heavy weight in assembly operation with frequent reeving of the hoisting cable and to position it with millimeter accuracy in its placement position, the crane operator can adjust the resolution or dampening on the control levers to a wide spread and long ramping times by suitable programming of his control system. This makes it possible to guarantee that even with significant movement of the control levers used as manual input devices, only slow speeds are produced in the drives. In the opposite way, the control system can be adjusted for high-speed operation, which is advantageous especially on construction sites for lifting smaller loads with less reeving of the hoisting cable for executing faster movements with high dynamics and short ramping times. Of course, it is possible to record significantly more than two or three different settings in the electronic control system. This is especially advantageous if several crane operators are to alternately use the given crane. This makes it possible for the performance of the crane to be optimally adapted to the naturally different concerns of the crane operators, who have developed different manners of operation on the basis of their experience. The installation expense necessary for implementing the present invention is low, since basically only suitable storage space in the control system and a software program needs to be made available.

What is claimed is:

1. A crane with a control system that can be operated by an operator, comprising:

drives for at least one hoisting unit and for crane movements;

manual input devices for actuating the drives for at least one hoisting unit and for crane movements; and an electronic control system for adjusting the sensitivity of the manual input devices, the electronic control system having at least two settings selectable by the operator, each of the at least two settings implementing different manual input device sensitivities defined for crane operation for adjusting a characteristic curve of control movements of the at least one hoisting unit and for crane movements in which there is comparatively high dampening of the control movements in an initial fine-control range of the characteristic curve and progressively changing behavior of the characteristic curve is provided in the remainder of the range until the maximum speed of the given drive is attained.

2. The crane of claim 1, wherein said electronic control system comprises a default setting, each of said at least two settings implementing different manual input device sensitivities than said default setting such that displacement of the manual input device into a certain control position in one of said at least two settings results much slower relative movement of at least one associated drive than the same control position at said default setting.

3. The crane of claim 2, wherein settings that differ from said default setting can be set by the operator via a touch screen of the electronic control system.

4. The crane of claim 3, wherein said electronic control system allows users to set values of the settings through the touchscreen.

5. The crane of claim 2, wherein said default setting is safely stored in the electronic control system.

6. The crane of claim 2, wherein dampening of the sensitivity of the manual input devices for assembly operation is adjusted to be so large that a maximum speed of the given drive associated with the manual input devices can be set only by switching to another type of operation.

7. The crane of claim 1, wherein said electronic control system comprises a default setting, and one of said at least two settings is provided for high-speed operation, in which, compared to a default setting, displacement of the manual input device into a certain control position results in relatively faster movement of at least one associated drive.

8. The crane of claim 7, wherein settings that differ from said default setting can be set by the operator via a touch screen of the electronic control system.

9. The crane of claim 7, wherein said default setting is safely stored in the electronic control system.

10. The crane of claim 1, wherein the electronic control system comprises a control program that excludes storage of settings in which values of speed and dynamics that can be achieved would be beyond permissible values for the crane.

11. The crane of claim 1, wherein the settings are individually stored for the operator in a form secured by a personal code.

12. The crane of claim 1, wherein settings selected for the current operation are displayed to the operator.

13. A crane with a control system that can be operated by an operator, comprising:

drives for at least one hoisting unit and for crane movements;

manual input devices for actuating the drives for at least one hoisting unit and for crane movements; and an electronic control system for adjusting the sensitivity of the manual input devices, the electronic control system having at least two settings selectable by the operator, each of the at least two settings implementing different manual input device sensitivities defined for crane operation, wherein the sensitivities associated with the at least two setting of the electronic control system adjust ramping times of the drives in order to control the drives, each said ramping times being an elapsed time between the time a drive starts and the time the drive reaches its desired speed.

14. The crane of claim 13, wherein the sensitivity of the manual input devices has a characteristic curve, in which there is comparatively high dampening of the control movements in an initial fine-control range and progressively changing behavior of the characteristic curve is provided in the remainder of the range until the maximum speed of the given drive is smoothly attained.

* * * * *